US008015634B1

(12) United States Patent
Lessard

(10) Patent No.: US 8,015,634 B1
(45) Date of Patent: Sep. 13, 2011

(54) INSULATOR FOR WATER CLOSET OF A TOILET

(76) Inventor: James P. Lessard, Mattituck, NY (US)

( * ) Notice: Subject to any disclaimer, the term of this patent is extended or adjusted under 35 U.S.C. 154(b) by 221 days.

(21) Appl. No.: 12/319,079

(22) Filed: Dec. 30, 2008

(51) Int. Cl.
*A47K 4/00* (2006.01)

(52) U.S. Cl. ..... 4/661; 4/353; 4/251.1; 220/4.06; 220/4.07; 220/4.24; 220/592.24

(58) Field of Classification Search ..... 4/901, 251.1, 4/353, 661; 150/156, 901, 661; 220/592.24, 220/3.6, 4.06, 4.07, 4.21, 23.91, 592.2
See application file for complete search history.

(56) References Cited

U.S. PATENT DOCUMENTS 1,032,317 A * 7/1912 Zwermann ..... 4/353
2,637,360 A 5/1953 Doebler
2,769,981 A 11/1956 Jaye
2,788,043 A * 4/1957 Dolnick ..... 4/661
3,068,490 A * 12/1962 Pokras ..... 4/661
3,087,524 A 4/1963 Dolnick
D217,248 S 4/1970 Basner
3,579,647 A 5/1971 Nielson
5,027,493 A 7/1991 Wood, Jr. et al.
5,073,998 A * 12/1991 Wood et al. ..... 4/661
D370,724 S 6/1996 Elsey

* cited by examiner

*Primary Examiner* — Gregory L Huson
*Assistant Examiner* — Lauren Heitzer
(74) *Attorney, Agent, or Firm* — Montgomery Patent and Design; Robert C. Montgomery

(57) ABSTRACT

An insulated cover for toilet water closets intended to prevent condensation and its associated damaging properties is herein disclosed. The water closet section of the toilet is covered on the bottom and all four (4) side surfaces up to a water line with a preformed foam covering. The foam is envisioned to be of a closed cell design similar to that used on insulating sleeves for glasses and canned beverages. The foam is approximately one-quarter (¼) inch thick and available in a wide variety of colors to match all bathroom decors. The foam covering would be made in halves that meet in a shiplap joint on the sides of the water closet. Finally, the cover would be held in place on the water closet with multiple strips of hook and loop fastener material, thus allowing it to be easily removed for replacement or cleaning.

10 Claims, 4 Drawing Sheets

INSULATOR FOR WATER CLOSET OF A TOILET

FIELD OF THE INVENTION

The present invention relates generally to an insulated cover for a toilet water closet intended to prevent condensation and its associated damaging properties.

BACKGROUND OF THE INVENTION

On warm days, condensation occurs on the exterior of toilet tanks. This process, commonly called "sweating", occurs when the surface of the tank, chilled by the cold water inside, meets with the hot humid ambient room temperature. The water vapor in the humid ambient air will condense on the exterior wall of the tank. If the toilet should be repeatedly flushed throughout the day, the tank remains chilled and will "sweat" continuously. After only a short amount of time, this water will fall to the floor and collect, where it can cause mold, mildew, floor rot and the like. In some cases the damage can become so acute that total replacement of the floor and complete remodeling of the bathroom is required costing up to thousands of dollars. Accordingly, there exists a need for a means by which toilet tanks can be dept from sweating in hot temperatures to avoid the problems as described above. The development of the invention herein described fulfills this need.

There have been attempts in the past to invent covers for toilets. U.S. Pat. No. D 370,724 issued to Elsey discloses a toilet tank skirt that appears to comprise a pleated piece of fabric that extends from the rim of a toilet water closet to the floor surface. Unfortunately, this design patent does not appear to be similar in appearance to the disclosed device, nor does it appear to provide any condensate reducing properties.

U.S. Pat. No. 5,027,493 issued to Wood et al. discloses a toilet tank cover that appears to comprise a frame to surround an existing toilet tank, brackets for mounting the frame onto the tank, and an actuator for flushing the toilet which replaces the existing flush handle. Unfortunately, this patent does not appear to disclose a water closet cover that comprises a urethane foam material that easily is attached to the water closet to prevent condensation from damaging bathroom surfaces.

U.S. Pat. No. D 217,248 issued to Rasner appears to be a form fitting cover that covers the water closet and the bowl of a toilet. Unfortunately, this design patent does not appear to be similar in appearance to the disclosed device, nor does it appear to comprise a two-piece sectional assembly that mounts onto the water closet of a toilet.

U.S. Pat. No. 3,579,647 issued to Nielsen discloses a one-piece toilet tank cover that is comprised of fabric and utilizes elastic to maintain the cover about the water closet. Unfortunately, this patent does not disclosed a water closet cover comprised of closed cell urethane foam that attaches in two (2) pieces via hook and loop fasteners to a water closet of a toilet.

U.S. Pat. No. 3,087,524 issued to Dolnick discloses a cover for toilet tanks that appears to comprise a unitary cover for the water closet portion of a toilet. Unfortunately, this patent does not appear to comprise a urethane foam material, nor does it provide easy access to the lid of the toilet as does the instant invention.

U.S. Pat. No. 2,769,981 issued to Jaye discloses a condensate inhibiting liner for the interior of a water closet of a toilet. Unfortunately, this patent does not disclose an insulating cover for the exterior of a toilet water closet.

U.S. Pat. No. 2,637,360 issued to Doebler discloses a waterproof elastic fabric cover for toilet tanks. Unfortunately, this patent does not disclose an insulating cover for the water closet of a toilet comprised of a closed cell urethane foam material that acts as a condensation barrier to prevent damage to bathroom surfaces.

SUMMARY OF THE INVENTION

In light of the disadvantages as previously described in the prior art; it is apparent that there is a need for an insulator for a water closet of a toilet to prevent condensation and its associated damaging properties.

An object of the insulator for the water closet of a toilet provides an insulating cover for a water closet that covers the bottom and all four (4) side surfaces of the water closet up to a water fill line using multiple strips of hook-and-loop fastener material.

Another object of the insulator for the water closet of a toilet comprises a rear cover bottom panel with a rear cover pipe slot that provides clearance to existing plumbing and fixtures.

A further object of the insulator for the water closet of a toilet provides cover assemblies made of an insulating foam material of sufficient planar stiffness so as to retain a rectangular shape during use.

Still another object of the insulator for the water closet of a toilet is to provide a wide variety of colors to match various bathroom decors.

Still a further object of the insulator for the water closet of a toilet is to provide various sizes to match popular toilet models and styles.

An aspect of the insulator for the water closet of a toilet comprises a rear cover assembly and a front cover assembly. The rear cover assembly and front cover assembly are joined along on side surfaces of a toilet water closet.

Another aspect of the insulator for the water closet of a toilet comprises a rear cover assembly comprising a first rear cover side panel, a second rear cover side panel, a first rear cover side joint surface, a second rear cover side joint surface, a rear cover bottom panel, a rear cover back panel, and a rear cover pipe slot. The rear cover bottom panel provides an insulating covering of a bottom portion of the water closet.

A further aspect of the insulator for the water closet of a toilet comprises a rear cover pipe slot comprising a semi-circular cut-out portion of the rear cover bottom panel at an intermediate location along a forward facing edge region.

Still another aspect of the insulator for the water closet of a toilet comprises a rear cover bottom panel further comprising an additional pair of hook-and-loop fasteners providing additional attachment means to corresponding hook-and-loop fastening strips affixed to the front cover assembly.

Still a further aspect of the insulator for the water closet of a toilet comprises a front cover assembly comprising a first front cover side panel, a second front cover side panel, a first front cover side joint surface, a second front cover side joint surface, a front cover bottom panel, a front cover back panel, and a front cover pipe slot. The front cover assembly comprises similar materials as the rear cover assembly with shiplap features of the front cover assembly formed in a complementing fashion to said rear cover assembly.

A method of utilizing the insulator for the water closet of a toilet may be achieved by performing the following steps: procuring a model of the device having dimensions which match a particular toilet water closet style; procuring a model of the device having desired decorative colors and patterns so as to match a bathroom décor; installing hook-and-loop fasteners horizontally around the water closet being positioned slightly below a water fill line using the adhesive back portion of the hook-and-loop fasteners; attaching the rear cover assembly to said water closet using the corresponding hook-and-loop fasteners located along the inside upper edge of the rear cover back panel and inside upper edges of the first and second rear cover side panels; installing the front cover assembly to the water closet using the corresponding hook-and-loop fasteners located along the top edges of the front cover back panel and top edges of the first and second front cover side panels; fastening the rear cover assembly to the front cover assembly by mating and pressing the hook-and-loop fasteners located along the first and second front cover side joints against the corresponding first and second rear cover side joint surfaces; mating and pressing the hook-and-loop fasteners along the front cover bottom panel against the fasteners along the bottom surface of the rear cover bottom panel; filling the water closet with water in a normal manner; and benefiting from reduced condensation forming upon a water closet outer surface and consequential damage caused by said condensate on bathroom surfaces using the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | insulator for water closet of a toilet |
| 20 | rear cover assembly |
| 22 | first rear cover side panel |
| 23 | second rear cover side panel |
| 25 | first rear cover side joint surface |
| 26 | second rear cover side joint surface |
| 27 | rear cover bottom panel |
| 28 | rear cover back panel |
| 30 | front cover assembly |
| 32 | first front cover side panel |
| 33 | second front cover side panel |
| 35 | first front cover side joint surface |
| 36 | second front cover side joint surface |
| 37 | front cover bottom panel |
| 38 | front cover back panel |
| 40 | rear cover pipe slot |

-continued

| | |
|---|---|
| 42 | front cover pipe slot |
| 50 | hook-and-loop fastener |
| 100 | toilet |
| 110 | water closet |

DETAILED DESCRIPTION OF THE PREFERRED EMBODIMENT

The best mode for carrying out the invention is presented in terms of its preferred embodiment, herein depicted within FIGS. 1 through 3*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an insulator for a water closet of a toilet (herein described as the "device") 10, which provides a means for insulating a toilet water closet 110 to prevent condensation and its associated damaging properties. The water closet 110 is covered on bottom and all four (4) side surfaces up to a water fill line with a pair of joined preformed foam covers being fastened thereto one another as well as to the water closet surfaces 110 using multiple strips of hook-and-loop fastener material 50.

Figure 1:
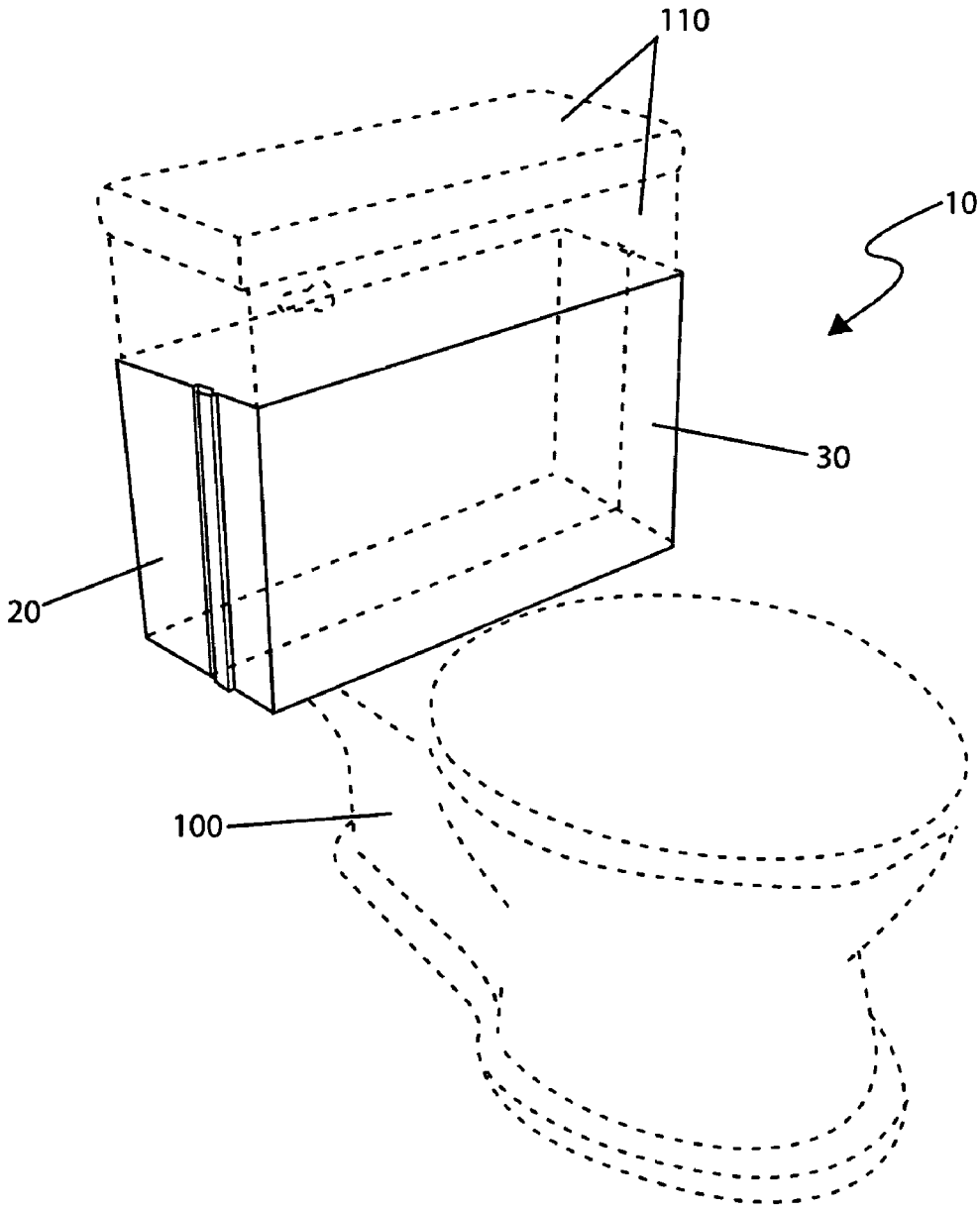
FIG. 1 is a front perspective view of an insulator for a water closet of a toilet 10 depicting installation upon a standard toilet 100, according to a preferred embodiment of the present invention.

Referring now to FIG. 1, a front perspective view of the device 10 depicting installation upon a standard toilet 100, according to the preferred embodiment of the present invention, is disclosed. The device 10 comprises a rear cover assembly 20 and a front cover assembly 30. The cover assemblies 20, 30 are made using an insulating foam material approximately one-quarter (¼) inch thick and are envisioned being introduced in a wide variety of colors to match various bathroom decors. The device 10 comprises two (2) halves being joined using a shiplap joint along on side surfaces of the toilet water closet 110. The two (2) halves of the device 10 are fastened thereto one another as well as to the water closet side surfaces 110 using multiple strips of hook-and-loop fastener material 50 thus allowing easy removal, replacement, or cleaning.

The device 10 is envisioned being introduced in various sizes comprising widths and depths having dimensions which match popular toilet 100 models and styles; however, it is also understood that a configurable version of the device 10 may be provided requiring trimming of perimeter edges using common scissors and custom application of the hook-and-loop fasteners 50 thereupon foam panel portions of the cover assemblies 20, 30 where needed, thereby allowing utilization of the device 10 thereupon a greater range of water closet 110 sizes.

Figure 2B:
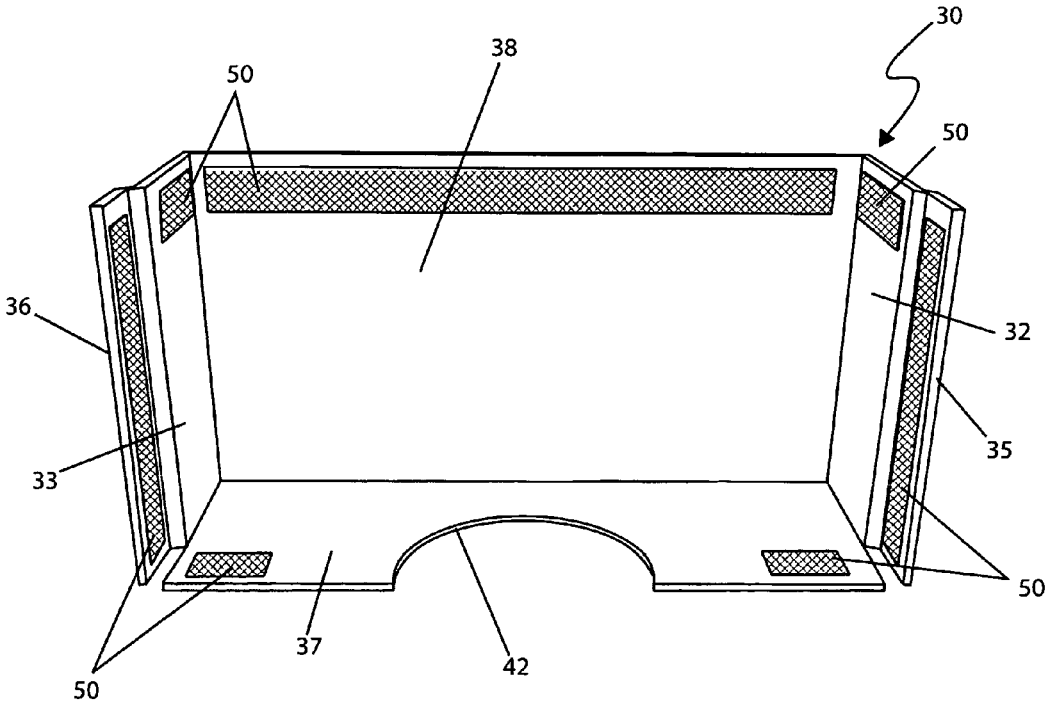
FIG. 2*b* is a perspective view of a front cover assembly 30 of the insulator for a water closet of a toilet 10, according to a preferred embodiment of the present invention.
Figure 2A:
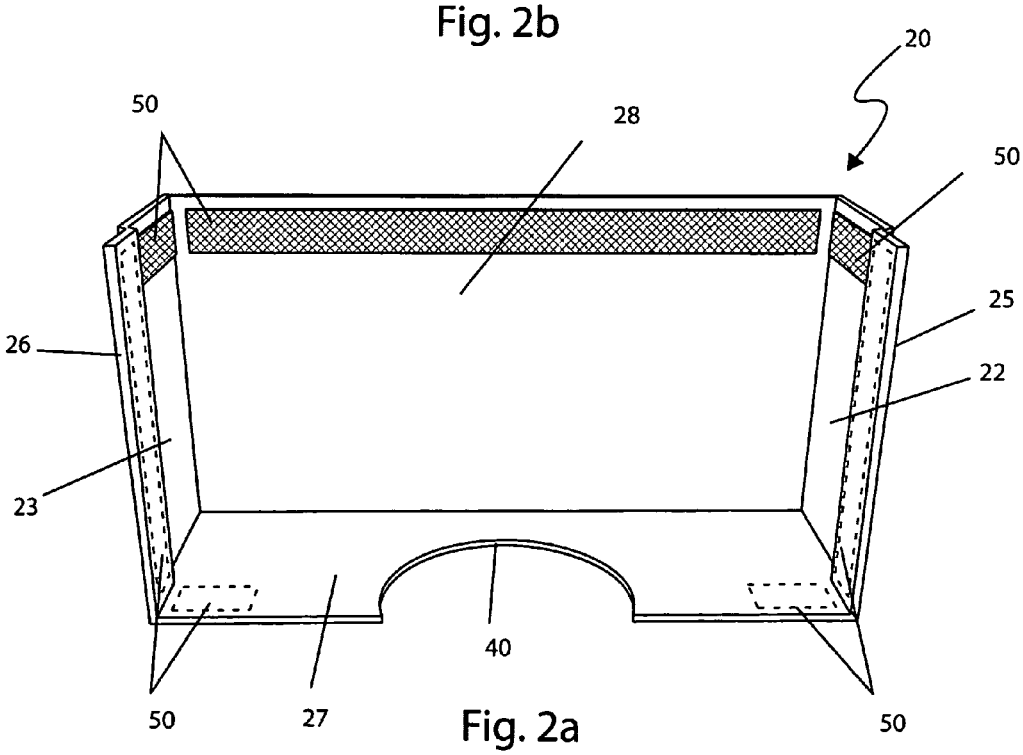
FIG. 2*a* is a perspective view of a rear cover assembly 20 of the insulator for a water closet of a toilet 10, according to a preferred embodiment of the present invention.

Referring now to FIG. 2*a*, a perspective view of a rear cover assembly 20 of the device 10, according to the preferred embodiment of the present invention, is disclosed. The rear cover assembly 20 comprises an open-front, five-sided enclosure having panels intersecting at right angles thereto one another to form a half-box structure. The rear cover assembly

20 comprises a first rear cover side panel 22, a second rear cover side panel 23, a first rear cover side joint surface 25, a second rear cover side joint surface 26, a rear cover bottom panel 27, a rear cover back panel 28, and a rear cover pipe slot 40. The rear cover assembly 20 is made using a dense closed cell urethane foam similar to that used on insulating sleeves for glasses and canned beverages. The foam material provides sufficient planar stiffness so as to retain a rectangular shape during use. Intersections of adjacent foam panels 22, 23, 27, 28 are to be formed at right angles using processes such as molding, hot pressing, heat welding, adhesives, or the like. The rear cover side 22, 23 and back 28 panels provide an attachment means thereto the water closet 110 via a plurality of hook-and-loop fastening strips 50 being approximately one (1) inch wide. The hook-and-loop fasteners 50 are affixed thereto the foam panels 22, 23, 28 along top inside edge regions preferably using adhesives; however, other attachment means may be utilized such as sewing, heat welding, or the like and as such should not be interpreted as a limiting factor of the invention 10. The water closet 110 likewise provides correspondingly located hook-and-loop fasteners 50 affixed thereto via common adhesive facing, thereby enabling engagement and support thereto the rear cover assembly 20 thereupon. The first 22 and second 23 rear cover side panels further comprise a first rear cover side joint surface 25 and a second rear cover side joint surface 26, respectively, being formed along vertical forward facing providing a shiplap type joint therewith the front cover assembly 30 (see FIGS. 1, 3*a* and 3*b*). The rear cover bottom panel 27 provides an insulating covering of a bottom portion of the water closet 110. The rear cover bottom panel 27 comprises a rear cover pipe slot 40 which provides clearance thereto expected flanges or plumbing which allow passage of a water flow therefrom the water closet 110 thereto the toilet 100 in a conventional manner. The rear cover pipe slot 40 comprises a semi-circular cut-out portion of the rear cover bottom panel 27 at an intermediate location along a forward facing edge region. The rear cover bottom panel 27 further comprises an additional pair of hook-and-loop fasteners 50 affixed thereto a bottom surface along forward facing edges providing additional attachment means thereto corresponding hook-and-loop fastening strips 50 affixed thereto the front cover assembly 30 (see FIG. 2*b*).

Referring now to FIG. 2*b*, a perspective view of a front cover assembly 30 of the device 10, according to a preferred embodiment of the present invention, is disclosed. The front cover assembly 30 comprises a first front cover side panel 32, a second front cover side panel 33, a first front cover side joint surface 35, a second front cover side joint surface 36, a front cover bottom panel 37, a front cover back panel 38, and a front cover pipe slot 42. The front cover assembly 30 comprises similar materials, shape, and construction as the aforementioned rear cover assembly 20; however, the shiplap features of the front cover assembly 30 are formed in a complementing fashion thereto said rear cover assembly 20, thereby comprising an outwardly offset first front cover side joint surface 35 and a second front cover side joint surface 36, respectively, thereby providing an aesthetic appearing vertical seam along side surfaces of the water closet 110 when assembled (see FIG. 1). Additionally, said first 35 and second 36 front cover side joint surfaces comprise corresponding hook-and-loop fastening strips 50 being arranged and affixed thereto the rear cover assembly 20 along inward facing surfaces.

Figure 3A:
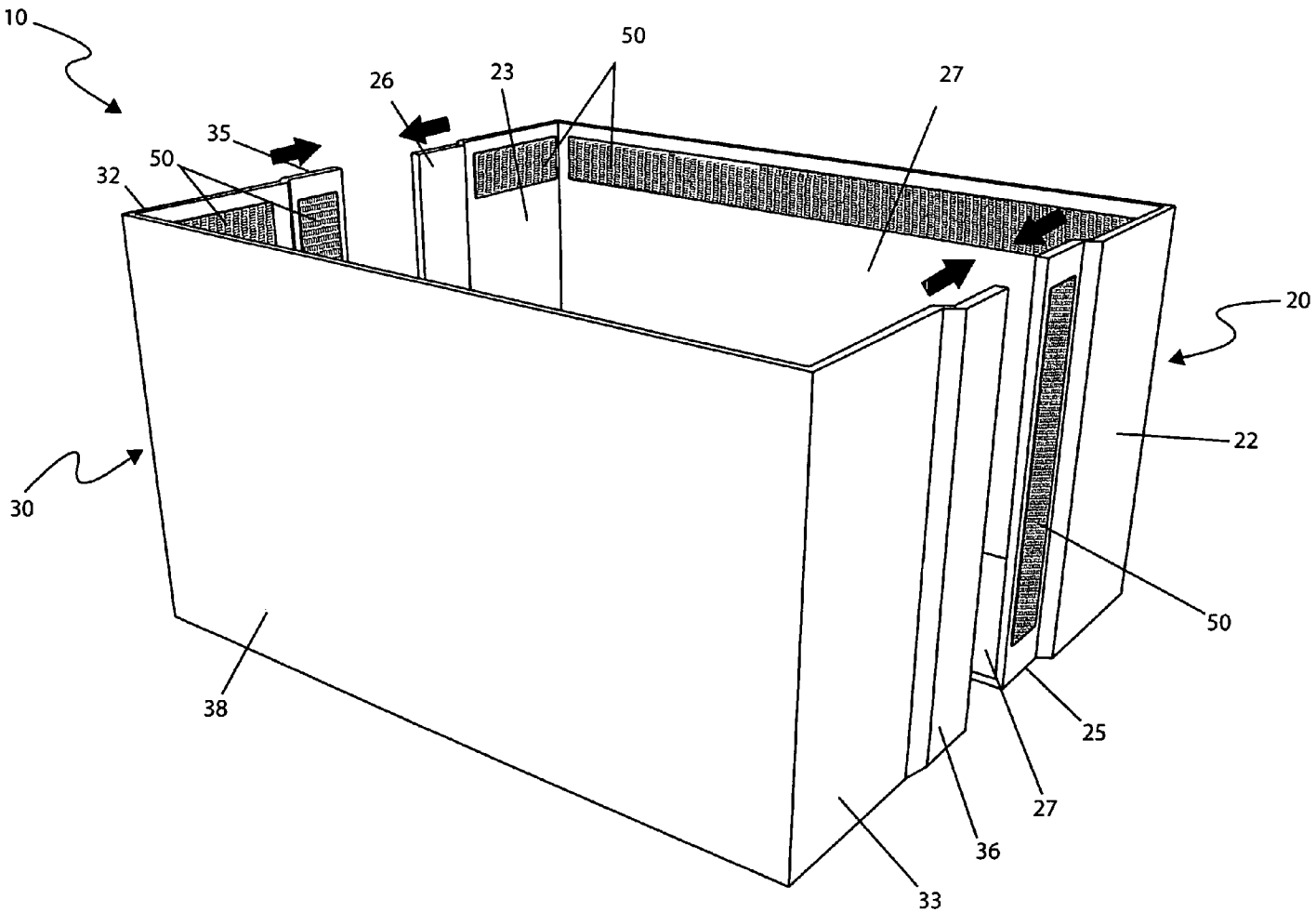
FIG. 3*a* is an assembly view illustrating a rear cover assembly 20 and front cover assembly portions 30 of the insulator for a water closet of a toilet 10, according to a preferred embodiment of the present invention; and, FIG. 3*b* is a close-up view of a lap joint portion of the insulator for a water closet of a toilet 10, according to a preferred embodiment of the present invention.
Figure 3B:
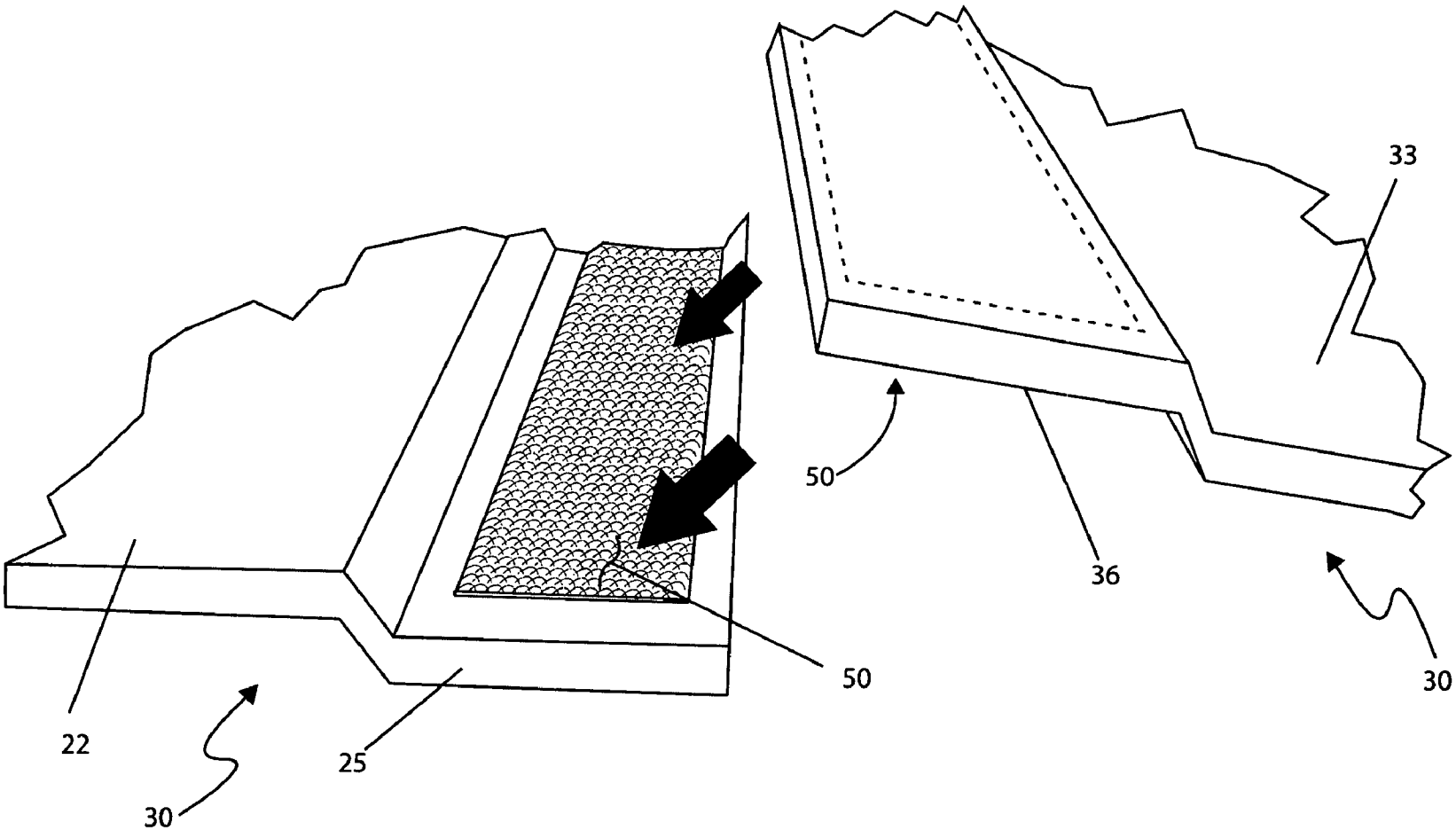

Referring now to FIGS. 3*a* and 3*b*, assembly and close-up views of lap-joint portions of the device 10, according to a preferred embodiment of the present invention, are disclosed. The first 22 and second 23 rear cover side panels comprise extending first 25 and second 26 rear cover side joint surfaces, respectively. Said rear cover side joint surfaces 25, 26 are formed along vertical forward facing edges providing a shiplap type joint thereto corresponding second 36 and first 35 front cover joint surfaces of the front cover assembly 30. Said joint surfaces 25, 26, 35, 36 comprise formed offset flat surfaces being parallel thereto one another as well as parallel thereto extending side panel portions 22, 23, 32, 33. The joint surfaces 25, 26, 35, 36 are offset approximately CM inch comprising additional affixed hook-and-loop fasteners 50 along mating surfaces, thereby enabling attachment of the front cover assembly 30 thereto the rear cover assembly 20 to form a smooth vertical joining seam. Closure of the device 10 around bottom surfaces of the water closet 110 (see FIGS. 2*a* and 2*b*) is accomplished via additional attachment therebetween the rear cover assembly 20 and the front cover assembly 30 by mating inner and outer hook-and-loop fasteners 50 affixed thereto the respective rear cover bottom panel 27 and the front cover bottom panel 37.

It is envisioned that other styles and configurations of the present, invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1, 3*a* and 3*b*.

The method of utilizing the device 10 may be achieved by performing the following steps: procuring a model of the device 10 having dimensions which match a particular toilet water closet style 110; procuring a model of the device 10 having desired decorative colors and patterns so as to match a bathroom décor; installing hook-and-loop fasteners 50 horizontally therearound the water closet 110 being positioned slightly below a water fill line using the adhesive back portion of the hook-and-loop fasteners 50; attaching the rear cover assembly 20 thereto said water closet 110 using the corresponding hook-and-loop fasteners 50 located along the inside upper edge of the rear cover back panel 28 and inside upper edges of the first 22 and second 23 rear cover side panels; installing the front cover assembly 30 thereto the water closet 110 using the corresponding hook-and-loop fasteners 50 located along the top edges of the front cover back panel 38 and top edges of the first 32 and second 33 front cover side panels; fastening the rear cover assembly 20 thereto the front cover assembly 30 by mating and pressing the hook-and-loop fasteners 50 located along the first 35 and second 36 front cover side joints thereagainst the corresponding first 25 and second 26 rear cover side joint surfaces; mating and pressing the hook-and-loop fasteners 50 along the front cover bottom panel 37 thereagainst the fasteners 50 along the bottom surface of the rear cover bottom panel 27; filling the water closet 110 with water in a normal manner; and benefiting from reduced condensation forming thereupon a water closet 110 outer surface using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An insulator for a water closet of a toilet, comprising:

an insulated rear cover assembly forming a first half-box structure comprising a first rear cover side panel, an offset first rear cover side joint surface, a second rear cover side panel, an offset second rear cover side joint surface, a rear cover bottom panel, and a rear cover back panel; and, an insulated front cover assembly forming a second half-box structure comprising a first front cover side panel, an offset first front cover side joint surface, a second front cover side panel, an offset second front cover side joint surface, a front cover bottom panel, and a front cover back panel;

wherein said first rear cover side joint surface is engageably mated to said second front cover side joint surface, said second rear cover side joint surface is engageably mated to said first front cover side joint surface, and said rear cover bottom panel is engageably mated to said front cover bottom surface for releasably attaching said rear cover assembly to said front cover assembly over an exterior of a lower portion of said water closet.

2. The insulator of claim 1, wherein said rear cover bottom panel further comprises a rear cover pipe slot and said front cover bottom panel further comprises a front cover pipe slot, thereby providing clearance for plumbing allowing passage of a water flow from said water closet to a toilet.

3. The insulator of claim 2, wherein an exterior of said first rear cover side joint surface and an interior of said second front cover side joint surface are fastened to form a shiplap joint to provide a planar exterior side joining seam and an exterior of said second rear cover side joint surface and an interior of said first front cover side joint surface are fastened to form a shiplap joint to provide a planar exterior opposing side joining seam when said rear cover assembly and said front cover assembly are attached over said water closet.

4. The insulator of claim 3, wherein said exterior of said first rear cover side joint surface and said second rear cover side joint surface each further comprises at least one affixed section of hook-and-loop fastener; and, said interior of said first front cover side joint surface and said second front cover side joint surface each further comprises at least one affixed communicating section of hook-and-loop fastener;

wherein said sections of hook-and-loop fastener engageably mate to releasably attach said rear cover assembly and said front cover assembly together.

5. The insulator of claim 4, wherein an exterior of said rear cover bottom panel further comprises at least one affixed section of hook-and-loop fastener and an interior of said front cover bottom panel further comprises at least one affixed communicating section of hook-and-loop fastener;

wherein said sections of hook-and-loop fasteners engageably mate to releasably attach said rear cover assembly and said front cover assembly together.

6. The insulator of claim 5, wherein said rear cover assembly and said front cover assembly each further comprises a semi-flexible insulated foam material having a thickness of at least one-quarter (¼) inch.

7. The insulator of claim 6, wherein an interior of said rear cover back panel and said front cover back panel each further comprises at least one affixed section of hook-and-loop fastener which engageably mate with a plurality of communicating sections of hook-and-loop fasteners adhered to said exterior of said water closet to provide support to said rear cover assembly and said front cover assembly when attached around said water closet.

8. The insulator of claim 7, wherein said insulated foam material further comprises a dense closed cell urethane.

9. The insulator of claim 6, wherein an interior of said rear cover back panel, said front cover back panel, said first rear cover side panel, said second rear cover side panel, said first front cover side panel, and said second front cover side panel each further comprises at least one affixed section of hook-and-loop fastener which engageably mate with a plurality of communicating sections of hook-and-loop fasteners adhered to said exterior of said water closet to provide support to said rear cover assembly and said front cover assembly when attached around said water closet.

10. The insulator of claim 9, wherein said insulated foam material further comprises a dense closed cell urethane.

* * * * *